United States Patent [19]

Nomura et al.

[11] 4,295,456

[45] Oct. 20, 1981

[54] EXHAUST-GAS-RECIRCULATION SYSTEM FOR USE IN DIESEL ENGINES

[75] Inventors: Etsuji Nomura, Okazaki; Kazuma Matsui, Toyohashi; Toshikuni Miyazaki, Okazaki; Hiroshi Sami, Numazu; Tatehito Ueda, Susono, all of Japan

[73] Assignees: Nippon Soken, Inc., Nishio; Toyota Jidosha Kogyo Kabushiki Kaisha, Toyota, both of Japan

[21] Appl. No.: 92,516

[22] Filed: Nov. 8, 1979

[30] Foreign Application Priority Data

Nov. 13, 1978 [JP] Japan ..... 53-140184

[51] Int. Cl.[3] ..... F02M 25/06

[52] U.S. Cl. ..... 123/569; 123/568

[58] Field of Search ..... 123/569, 568, 571

[56] References Cited

U.S. PATENT DOCUMENTS 2,456,213 12/1948 Pelc ..... 123/568 X 4,020,809 5/1977 Kern et al. ..... 123/569

FOREIGN PATENT DOCUMENTS 1802315 10/1968 Fed. Rep. of Germany ..... 123/569

2658052 6/1978 Fed. Rep. of Germany ..... 123/569

*Primary Examiner*—Wendell E. Burns

*Attorney, Agent, or Firm*—Cushman, Darby & Cushman

[57] ABSTRACT

An exhaust-gas-recirculation system for use in diesel engines, having a valve member adapted to control the flow rate of the exhaust gas recirculated from the exhaust pipe to the intake pipe of the diesel engine. The exhaust-gas-recirculation system has a fly-weight rotatable in synchronization with the engine to produce a centrifugal force, a governor sleeve displaceable in response to a thrust thereon given by the fly-weight, a control spring counteracting the thrust on the governor sleeve and having a spring load changeable in response to the change in the amount of depression of an accelerator pedal, and an actuator operative in response to the displacement of the governor sleeve to actuate the valve member.

4 Claims, 11 Drawing Figures

EXHAUST-GAS-RECIRCULATION SYSTEM FOR USE IN DIESEL ENGINES

BACKGROUND OF THE INVENTION

1. Field of the Invention

The present invention relates to an exhaust-gas-recirculation system for controlling the emission of noxious components, particularly nitrogen oxides (NOx) of the exhaust gas emitted from diesel engines.

2. Description of the Prior Art

It is well known to use exhaust-gas-recirculation system (hereinafter referred to as "E.G.R. system") for recirculating a part of the exhaust gas to the intake system of an internal combustion engine to control the emission of noxious components, particularly nitrogen oxides (NOx) of the exhaust gas from the internal combustion engine. In case of emission control in diesel engines, it is a common measure to reduce the E.G.R. ratio (the ratio of flow rate of recirculated exhaust gas to the sum of the flow rate of intake air and the flow rate of recirculated exhaust gas) as the load applied to the engine is increased. To this end, conventionally, the E.G.R. ratio has been controlled in relation to the amount of depression of the accelerator pedal. This permits the control of the E.G.R. ratio in response to the change in level of load if the accelerator pedal is operated to compensate for the change in level of the load to maintain a constant engine speed. However, if the automobile runs with the constant position of the accelerator pedal irrespective of the change in level of the load, the engine speed is changed in response to the change in level of the load, while the E.G.R. ratio is kept unchanged.

Thus, the conventional system could not provide the optimum control of the E.G.R. ratio in response to the change in the level of load over all modes of engine control, although the control of E.G.R. ratio is made satisfactorily in some specific modes of engine control.

SUMMARY OF THE INVENTION

It is, therefore, an object of the invention to provide an exhaust-gas-recirculation system for diesel engines, capable of controlling the E.G.R. ratio in response to both of the change in the amount of depression of the accelerator pedal and to the change in the engine speed.

To this end, according to the invention, there is provided an exhaust-gas-recirculation system for use in a diesel engine having an intake pipe connected to the engine to introduce fluid thereinto and an exhaust pipe connected to the engine to discharge the exhaust gas emitted from the engine, the system including an exhaust-gas-recirculation passage having one end thereof connected to the intake pipe and the other end connected to the exhaust pipe and valve means associated with the exhaust-gas-recirculation passage to control the flow rate of the exhaust gas to be recirculated from the exhaust pipe to the intake pipe through the exhaust-gas-recirculation passage, wherein the improvement comprises: a shaft rotatable in synchronization with the engine; a fly-weight mounted on the shaft to produce a centrifugal force upon the rotation of the shaft; a governor member movable in response to a thrust acting thereon due to the centrifugal force produced by the fly-weight; at least one control spring acting against the thrust on the governor member and having a spring load variable in response to the change in amount of depression of an accelerator pedal; and actuating means for operative in response to the movement of the governor member to actuate the valve means.

According to the exhaust-gas-recirculation system of the invention having the above-described features, it is possible to control the E.G.R. ratio in response to both of the depression amount of the accelerator pedal and the engine speed by suitably adjusting the force corresponding to the depression of the accelerator pedal.

The above and other objects, as well as advantageous features of the invention will become more clear from the following descriptions of the preferred embodiments taken in conjunction with the accompanying drawings.

DESCRIPTION OF THE PREFERRED EMBODIMENTS

Figure 1:
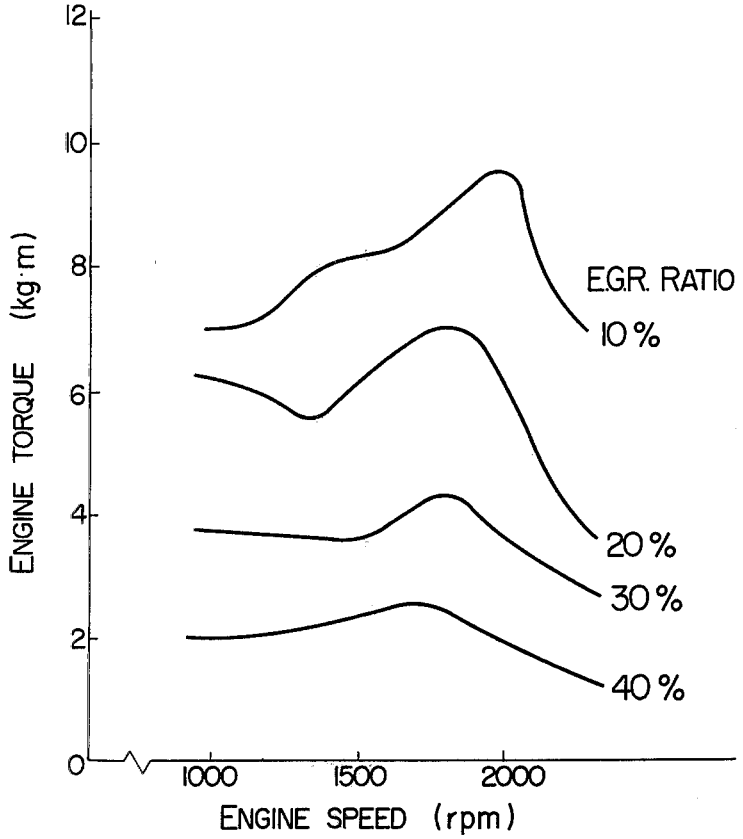
FIG. 1 is a chart showing the exhaust-gas-recirculation control characteristic generally required in diesel engines.

FIG. 1 shows the optimum E.G.R. ratio for maximizing the effect of NOx reduction, while maintaining the generation of hydrocarbon and smoke within the allowable range, in a 4-cycle, 4-cylinder engine having vortex flow type combustion chambers of a total displacement of 2200 cc. From this Figure, it will be seen not only that the E.G.R. ratio is preferably reduced as the load increases but also that, in a more strict sense, the E.G.R. ratio is preferably controlled also in relation to the engine speed.

Under this circumstance, the invention aims at providing an exhaust-gas-recirculation system for diesel engine, which comprises a first mechanism rotatable in synchronization with the engine to produce a force corresponding to the engine speed, and a second mechanism for producing a force dependent upon the amount of depression of an accelerator pedal, wherein a valve for controlling the E.G.R. ratio is directly or indirectly actuated by a balance of the forces produced by the first and second mechanisms, respectively such that the E.G.R. ratio is increased as the force of the first mechanism increases but is decreased as the force of the second mechanism increases.

Figure 2:
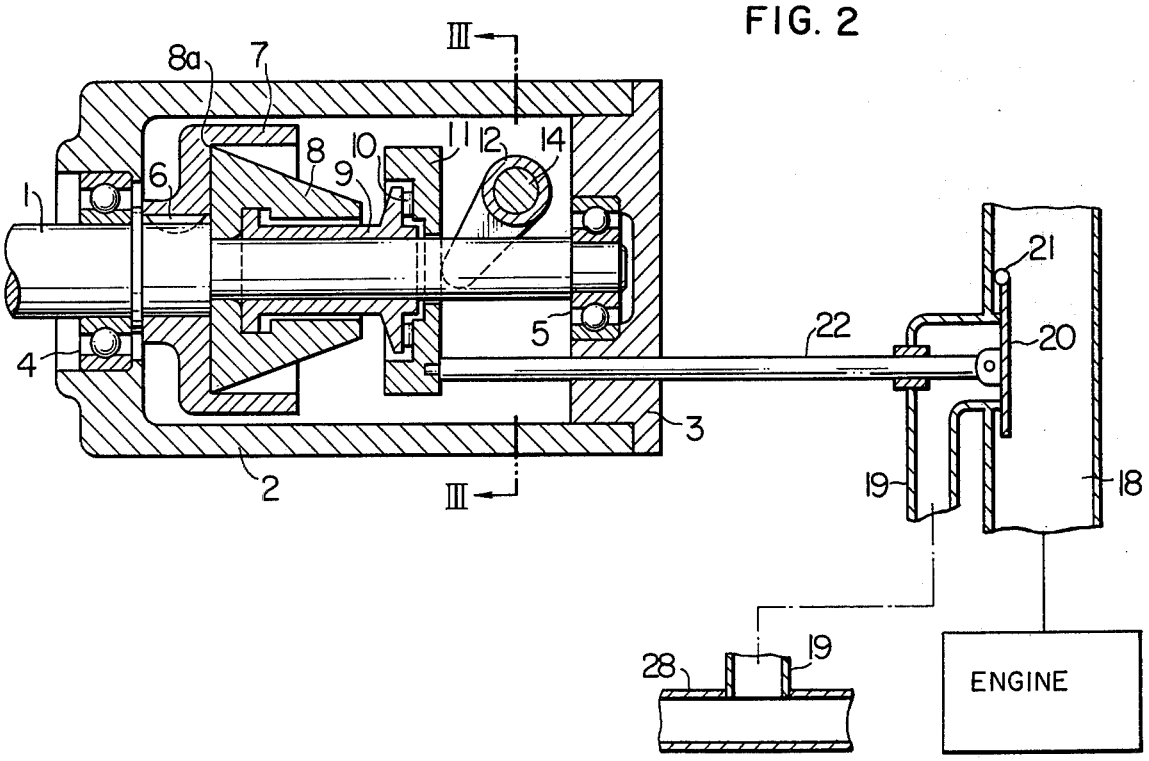
FIG. 2 is a schematic sectional view of a first embodiment of the invention.
Figure 3:
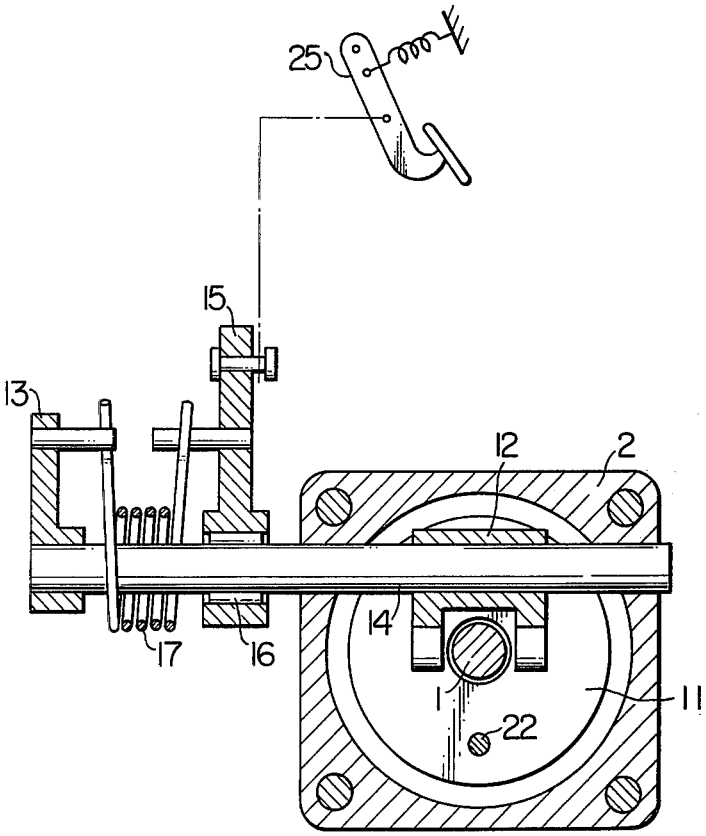
FIG. 3 is a sectional view taken along the line III—III of FIG. 2.

Referring to FIGS. 2 and 3 showing a first embodiment of the invention, a governor shaft 1 is rotatably carried by the housing 2 and the housing cover 3 through the medium of bearings 4 and 5, respectively. The governor shaft 1 is operatively connected to the crank shaft of a diesel engine E through a transmission mechanism (not shown) comprising pulleys and a belt or gears such that the shaft 1 rotates in synchronization with the crank shaft of the engine. A governor housing 7 is fixed to this governor shaft 1 by means of an arcuate key 6. A fly-weight 8 having a plurality of segments is incorporated in the governor housing 7. The arrangement is such that the segments of the fly-weight 8 pivot around their respective pivot points 8*a* by the centrifugal force acting thereon, as the governor shaft 1 rotates. A governor sleeve 9, thrust bearing 10 and control block 11 are mounted on the governor shaft 1. The governor sleeve 9 and the control block 11 are movable or displaceable in the axial direction, i.e. to the right as viewed on the drawings, by the centrifugal force acting on the fly-weight 8.

A control lever 12 and a tension lever 13 are fixedly mounted on a control shaft 14. An accelerator lever 15 is rotatably carried by the control shaft 14 through the medium of a needle bearing 16. A control spring 17 has ends thereof engaging with the tension lever 13 and the accelerator lever 15, respectively. This control spring 17 is adapted to counteract the centrifugal force of the fly-weight 8, through the tension lever 13, control shaft 14 and the control lever 12. The load of the control spring 17 is changed as the accelerator lever 15 is angularly moved. The accelerator lever 15 is operatively connected to an accelerator pedal 25 of the automobile and also to an adjusting lever of a fuel injection pump which is not shown.

An exhaust-gas-recirculation passage 19 is connected at its one end to an exhaust pipe 28 and, at its other end, to an intake pipe 18 of the engine. A valve member 20 is pivotally secured to the wall of the intake passage 18 for a pivotal movement around a pivot 21 to open and close the opening of the exhaust-gas-recirculation passage 19. A valve actuating rod 22 is secured at its one end to the valve member 20 and at its other end to the control block 11. The arrangement is such that the axial displacement of the control block 11 is directly transmitted through the valve actuating rod 22 to the valve member 20 to cause the pivotal movement of the pivot 21 to vary the area of the opening of the exhaust-gas-recirculation passage 19.

Figure 4:
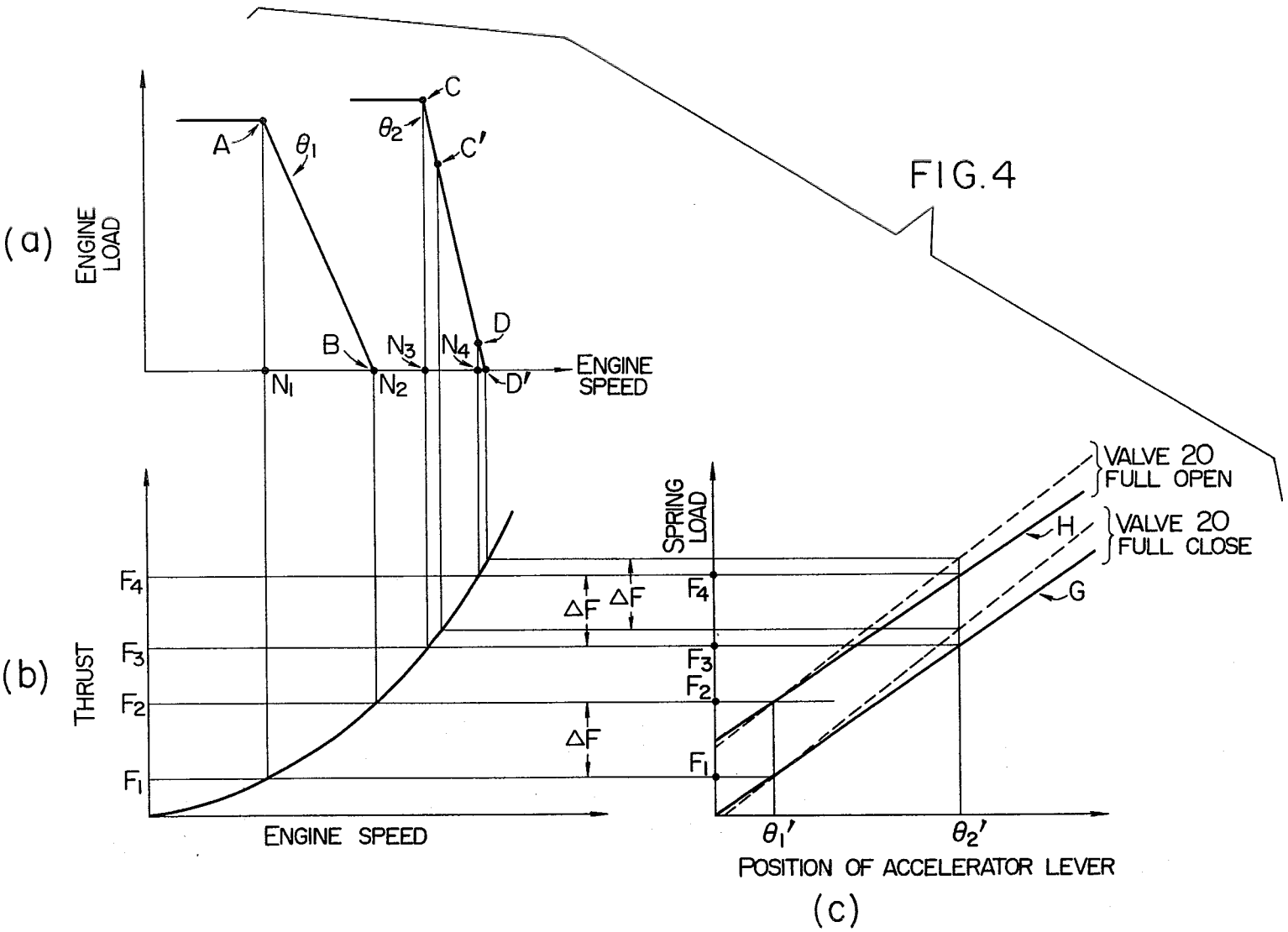
FIG. 4 parts a, b and c are characteristic charts explanatory of the operation of the first embodiment of the invention.

In FIG. 4, parts a, b and c are diagrams illustrating the operation characteristic of the embodiment having the described construction. More specifically, part a of FIG. 4 shows the relationship between the engine speed and the load applied to the engine as observed when the accelerator pedal 25 is fixed at the angle $\theta_1$ or $\theta_2$, the relationship being determined by the operation of the governor of a fuel injection pump which is known per se. Also, the relationship between the engine speed and the thrust applied to the sleeve 9 due to the centrifugal force generated in the fly-weight 8 is shown at part b in FIG. 4. Finally, part c of FIG. 4 shows the relationship between the position of the accelerator lever 15 and the spring load on the control spring 17, by way of example. The spring load on the control spring obviously varies depending on the position of the control block 11, i.e. the opening degree of the valve member 20. Therefore, the relationships observed when the valve member 20 is fully closed and fully opened are shown by full-line curves G and H, respectively.

It is assumed here that the exhaust-gas-recirculation is controlled in such a manner as to actuate the valve member 20 for fully closing the exhaust-gas-recirculation passage 19 to make the E.G.R. ratio 0 (zero) during the full-load operation of the engine, and for fully opening the exhaust-gas-recirculation passage during no load operation of the engine. Assuming here also that the accelerator pedal 25 takes constantly an angular position $\theta_1$, the engine speed at full load operation is $N_1$ as determined by a point A in a of FIG. 4. In this state, a thrust $F_1$ is exerted on the sleeve 9. Therefore, the preload of the control spring 17 is so determined that the total load applied to the control spring 17 equals to the thrust force $F_1$ with the valve member urged to the position for fully closing the exhaust-gas-recirculation passage, when the accelerator lever 15 takes a position $\theta_1'$ which corresponds to the position $\theta_1$ of the accelerator pedal 15. The engine speed in the no load operation is determined to be $N_2$ from the same curve of part a FIG. 4 by a point B. The spring constant of the control spring 17 is, therefore, determined to permit the valve member 20 to fully open the exhaust-gas-recirculation passage by the thrust force $F_2$ corresponding to the engine speed $N_2$.

Supposing here that the accelerator pedal 25 is depressed to take another position $\theta_2$, it is necessary that the valve member 20 is brought to the position for fully closing the exhaust-gas-recirculation passage when the engine operates at full load which is represented by a point C in part a of FIG. 4. To this end, it is desired that the set load (the load applied to the spring when the valve member 20 takes the full-closing position) of the control spring 17 balances the thrust force $F_3$ corresponding to the engine speed $N_3$ even by the point C of part a of FIG. 4, when the accelerator lever takes the position $\theta_2'$ corresponding to the position $\theta_2$ of the accelerator pedal 25. This can be achieved by properly setting the ratio of stroke of the accelerator lever 15 to that of the accelerator pedal 25, through suitably selecting the motion ratio of the mechanical connection between the accelerator pedal 25 and the accelerator lever 15.

If the load is decreased to the level of a point D in part a of FIG. 4, the engine speed is increased to $N_4$ so that the thrust force is increased from $F_3$ to $F_4$. The increment $\Delta F$ of the thrust force equals to the difference between the thrust forces $F_2$ and $F_1$. As a result of the increase of the thrust force to $F_4$, the valve member 20 is swung to the position for fully opening the exhaust-gas-recirculation passage. It will be understood that, according to the described embodiment of the invention, it is possible to effect a good control of the E.G.R. ratio in response to the load, over the entire range of the engine speed.

In some cases, it is desired to maintain a comparatively small E.G.R. ratio during the high speed operation of the engine, irrespective of the level of the load. To cope with this demand, the load applied to the control spring 17 when the accelerator lever 15 takes the position $\theta_2'$ may be increased as shown by the broken-line curves in part c of FIG. 4. By so doing, it is possible to control the valve member 20 such that it fully closes and fully opens the exhaust-gas-recirculation passage at points C' and D', respectively.

In the desired embodiment, the governor shaft 1 is driven independently by means of a belt or the like means. This, however, is not exclusive, and the governor shaft 1 may be driven by suitable member which rotates in synchronization with the rotation of the crank shaft of the engine E. e.g. the shaft of an alternator and so forth.

Figure 5:
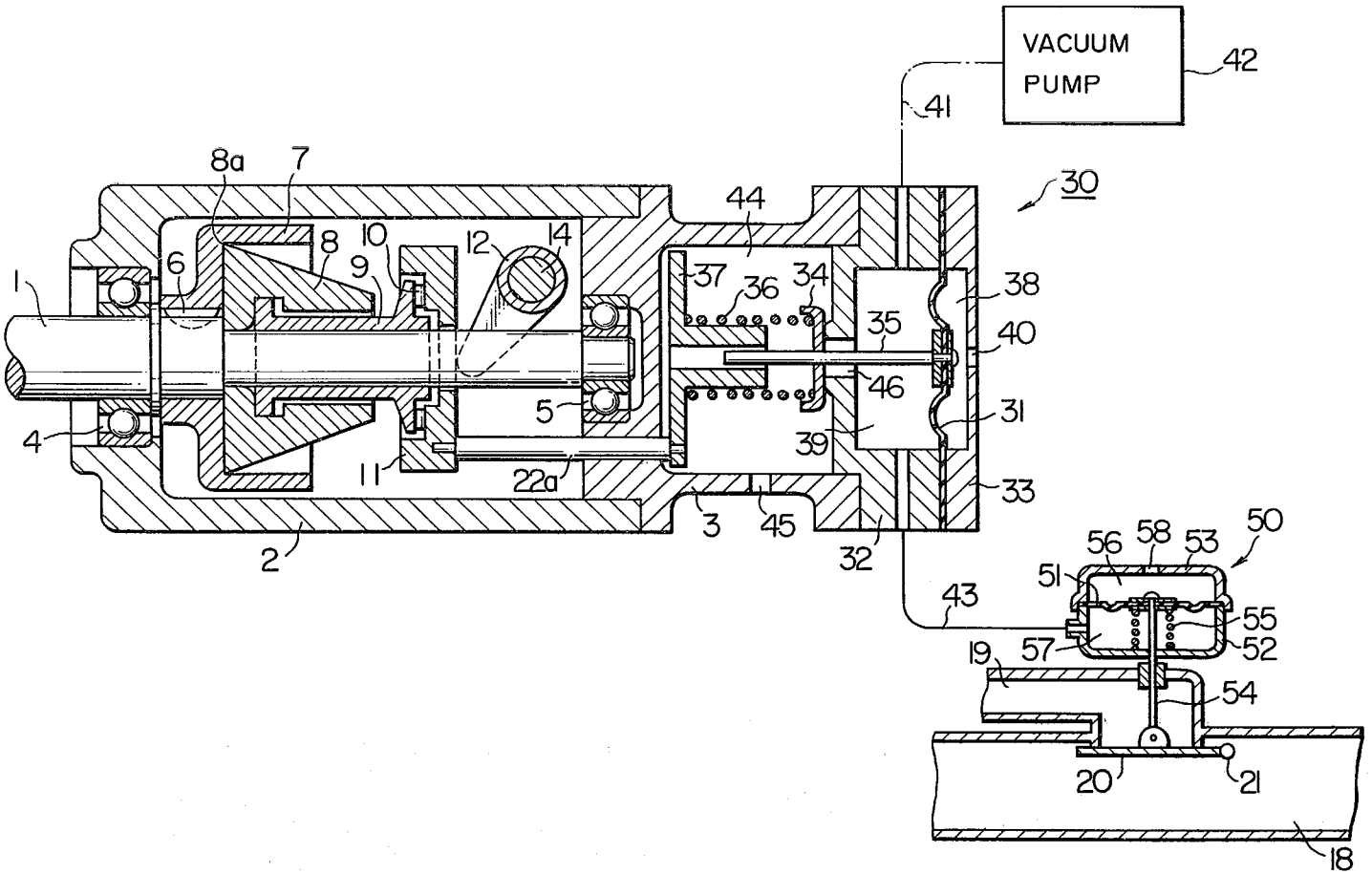
FIG. 5 is a schematic sectional view of a second embodiment of the invention.

FIG. 5 shows a second embodiment of the invention in which the parts and members same as those of the first embodiment are designated at the same reference numerals. Insteadly of the valve actuating mechanism of the first embodiment employing the valve actuating rod 22 for directly actuating the valve member 20, this second embodiment shown in FIG. 5 incorporates a valve actuating system for actuating the valve member 20. This valve actuating system includes a pressure adjusting device 30 which is adapted to produce a vacuum signal corresponding to the axial displacement of the control block 11. The opening degree of the valve member 20 is determined in accordance with the level of the vacuum signal.

More specifically, the pressure adjusting device 30 has a diaphragm 31 clamped between a housing 32 and a cover 33, a rod 35 through which the diaphragm 31 is connected to a valve member 34, a spring 36 adapted to bias the valve member 34 to the right and a spring seat 37 fixed to a control rod 22*a*. Two chambers 38 and 39 are defined at respective sides of the diaphragm 31. The right-side chamber 38 is communicated with the atmosphere through a port 40, while the left-side chamber 39 is communicated with a vacuum pump 42 through a conduit 41 and also with a diaphragm device 50 through a conduit 43. The chamber defined by the housing cover 3 and the housing 32 is opened to the atmosphere through a port 45, and is communicated with the chamber 39 through a port 46.

The vacuum in the chamber 39 generates a force for deflecting the diaphragm 31 to the left counteracting the force of the spring 36. Thus, the diaphragm 31 is deflected to a position where the leftward biasing force generated by the vacuum is balanced by the rightward biasing force of the spring, so that the valve member 34 connected to the diaphragm 31 is moved to open and close the port 46.

The valve actuating system of this second embodiment further includes the aforementioned diaphragm device 50 which includes a diaphragm 51, a housing 52 and a cover 53 between which the diaphragm 51 is clamped, a rod 54 through which the diaphragm 51 is connected to the valve member 20, and a spring 55 adapted for biasing the diaphragm 51 upwardly. Two chambers 56, 57 are defined at respective sides of the diaphragm 51, the upper one 56 of which is in communication with the atmosphere through a port 58, while the lower one 57 is adapted to receive the pressure in the pressure chamber 39 of the pressure adjusting device 30, through the conduit 43.

According to this arrangement, the load applied to the spring 36 is changed in response to the displacement of the control block 11, so that the force for rightwardly biasing the valve member 34 is changed correspondingly. Therefore, a vacuum corresponding to the displacement of the control block 11 can be obtained in the chamber 39, by opening and closing the port 46 through which the chamber 44 and the chamber 39 are communicated with each other. This vacuum signal is transmitted to the chamber 57 of the diaphragm device 50 and the opening degree of the valve member 20 is determined in accordance with the level of this vacuum signal, i.e. the displacement of the control block 11. It is, therefore, possible to obtain the same effect as that achieved by the first embodiment. This second embodiment can advantageously be carried out particularly in the case where the coaxial or close positioning of the valve member 20 and the governor shaft 1 of the first embodiment with each other is prohibited, and the case where it is desired to avoid the adverse affect of friction of the intermediate mechanism such as link and lever.

Figure 6:
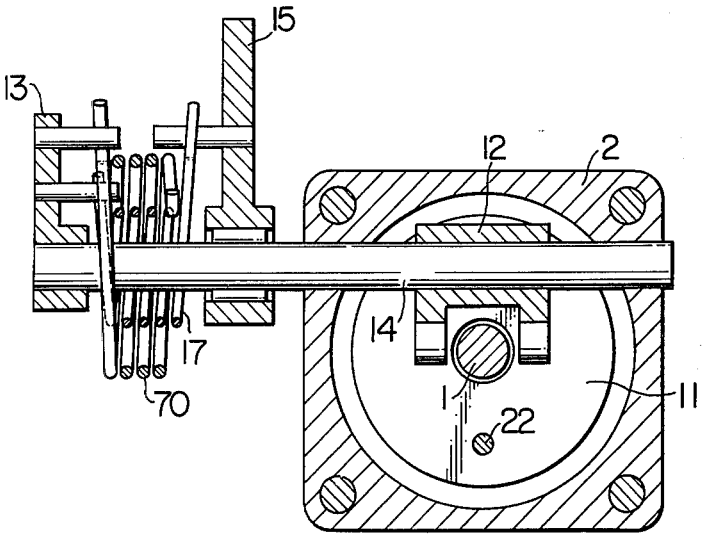
FIG. 6 is a sectional view of an essential part of a third embodiment of the invention.
Figure 7A:
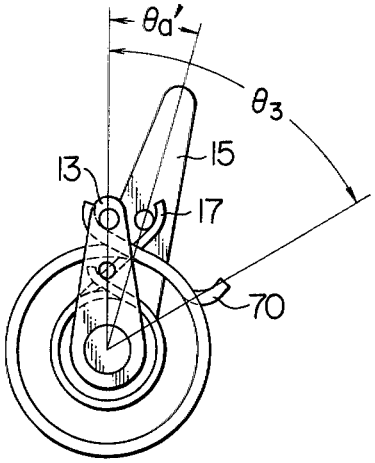
FIGS. 7*a* and 7*b* are illustrations for explaining the operation of the third embodiment.

FIG. 6 shows a third embodiment of the invention, in which the same reference numerals are used to denote the same members or parts as those of the first embodiment. In this third embodiment, another control spring 70 is disposed around the control spring 17 of the first embodiment. The arrangement is such that only the spring load of the control spring 17 is applied to the tension lever 13 when the opening degree $\theta_a'$ of the accelerator lever 15 is smaller than a predetermined opening $\theta_3'$ as shown in FIG. 7*a*. However, as the accelerator lever opening $\theta_a'$ is increased beyond the predetermined opening $\theta_3'$, the spring load of the outer control spring 70 is applied to the tension lever 13, in addition to the load of the inner control spring 17, as will be seen from FIG. 7*b*.

Figure 7B:
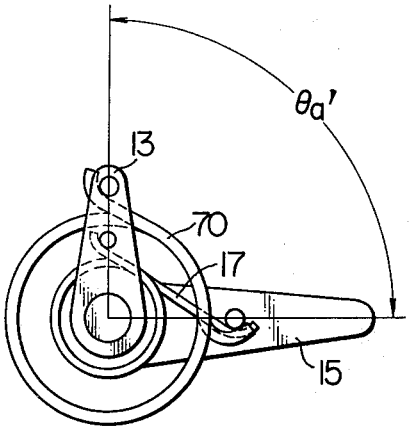

The position of the tension lever 13 as illustrated in FIGS. 7*a* and 7*b* corresponds to the fully-opening state of the valve member 20. When the valve member 20 is in the position for fully closing the exhaust-gas-recirculation passage, the tension lever 13 takes a position rotated by $\alpha°$ in the clockwise direction from the position shown in FIGS. 7*a* and 7*b*. Therefore, if the valve member 20 is in the fully-closing position, the tension lever 13 is subjected to the combined force of the control springs 17, 70 only when the opening degree $\theta_a'$ of the accelerator pedal is greater than the sum of the above-mentioned angle $\alpha$ and the aforementioned predetermined opening $\theta_3$ of the accelerator lever. It will be seen that, according to this embodiment, characteristics as shown by broken line curves G' and H' are obtained, whereas the characteristics shown by the full-line curves G and H are obtained when the control spring 17 is used solely.

Figure 8:
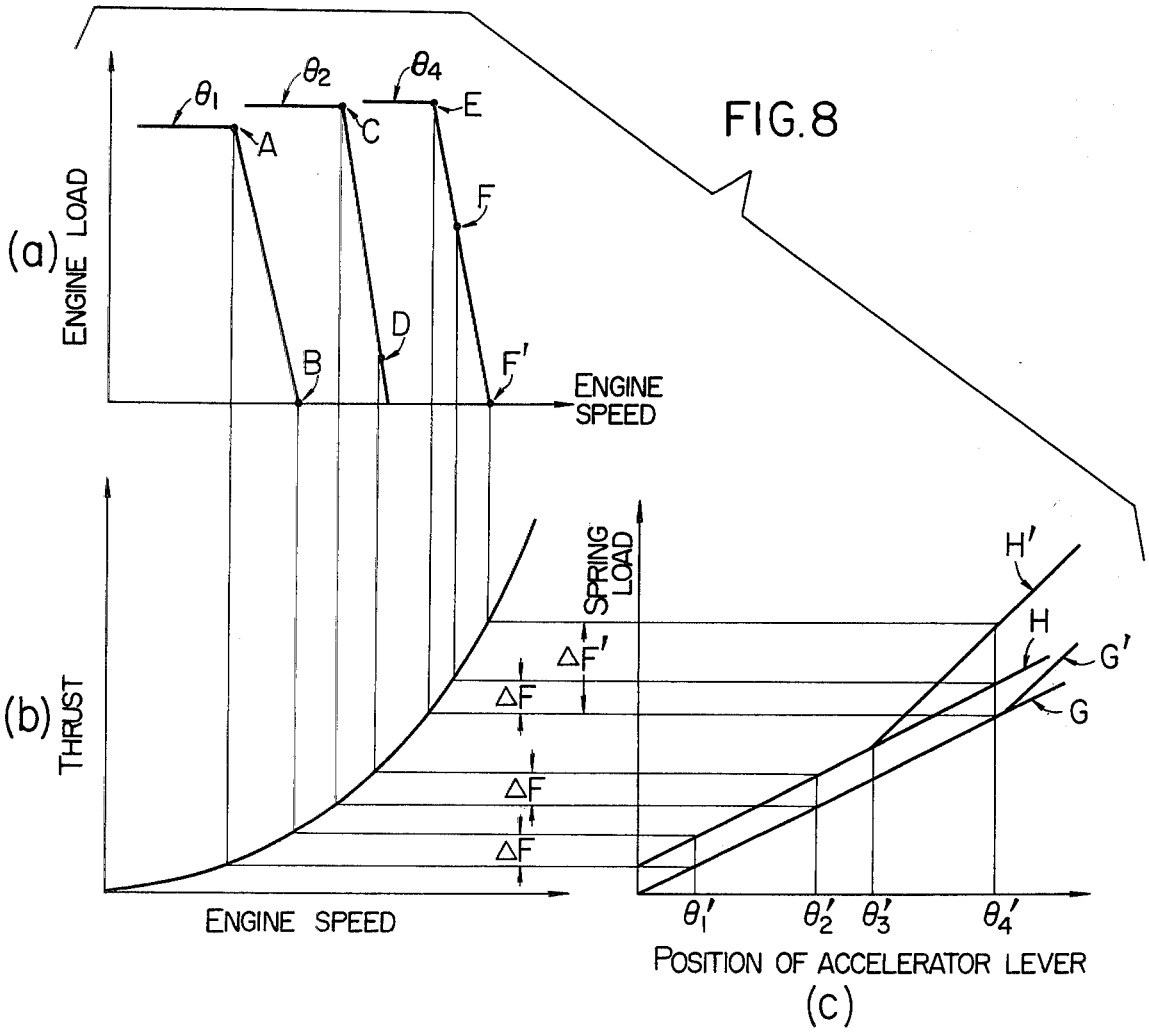
FIG. 8 is a characteristic chart for explaining the operation of the third embodiment.

Since the centrifugal force acting on the fly-weight 8, i.e. the thrust force exerted on the sleeve 9, is increased in proportion to the square of the engine speed, the valve member 20 is moved from the fully-closing position to the fully-opening position by a small increment of engine speed in the high speed range of the engine operation. In such a case, if the valve member 20 is set to be fully closed at a point E with the accelerator pedal kept at position $\theta_4$, the valve member 20 is inconveniently opened fully at a point F, as shown in part a of FIG. 8. This means that the exhaust-gas-recirculation is made at an excessively large rate in the medium load range, resulting in a bad operating condition of the engine.

For overcoming this problem by a sole control spring 17, it is considered to increase the set load of the spring 17 when the accelerator lever takes the position $\theta_4$, in the same manner as the aforementioned reduction of E.G.R. ratio at the high speed operation of the engine. This, however, requires to fully close the valve member 20 at the medium load range, which in turn deteriorate the effect of the exhaust-gas-recirculation.

According to the arrangement of this embodiment employing two control springs, the increment of the spring load for driving the valve member 20 from the fully-closing position to the fully-opening position is increased. As a result, the increment $\Delta F'$ of the counteracting centrifugal force for driving the valve member 20 is correspondingly increased so that the control of the E.G.R. ratio can be performed over wider range of engine speed. More practically, the point at which the valve member 20 fully opens is shifted from the point F to a point F' in the chart shown in part a of FIG. 8.

The use of two control springs is not exclusive, and the number of the control springs is changeable depending on the type of engine or the fuel injection pump, the desired range of control and other factors. In some cases, a satisfactory control can be achieved by only one control spring, whereas, for effecting a more strict and precise control, more than three control springs may be used in combination.

Figure 9:
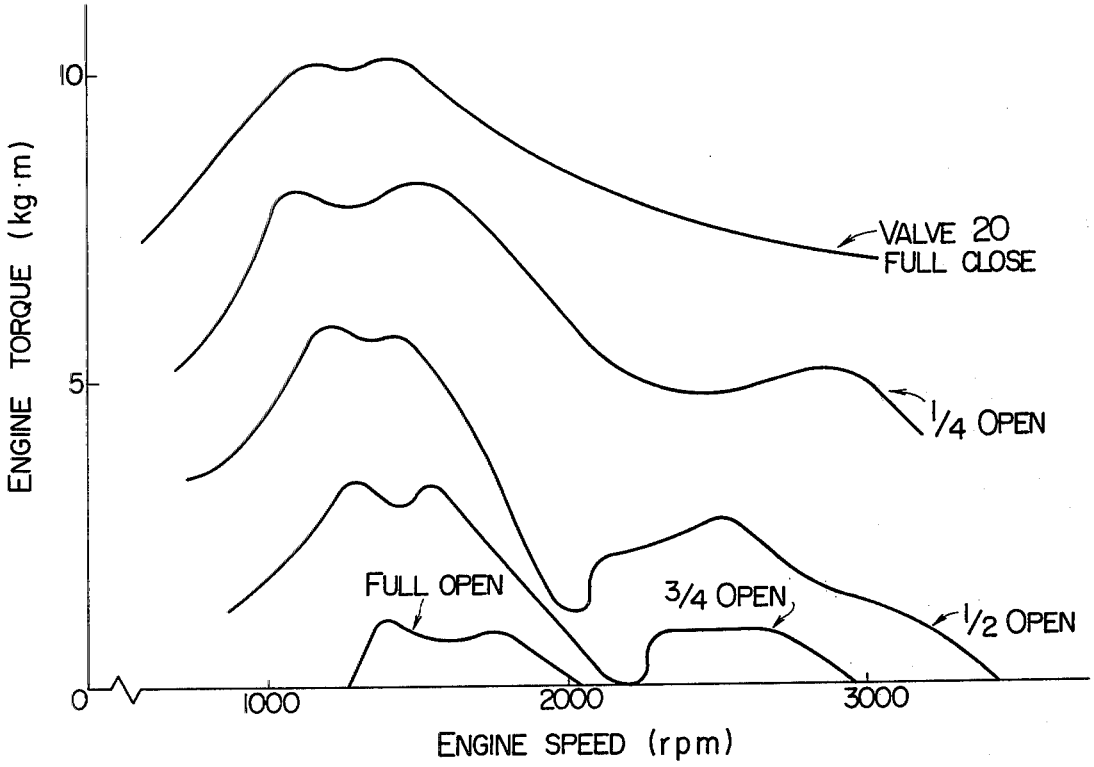
FIG. 9 is a characteristic chart showing the characteristic of control of the exhaust-gas-recirculation as performed by the third embodiment of the invention.
Figure 10:
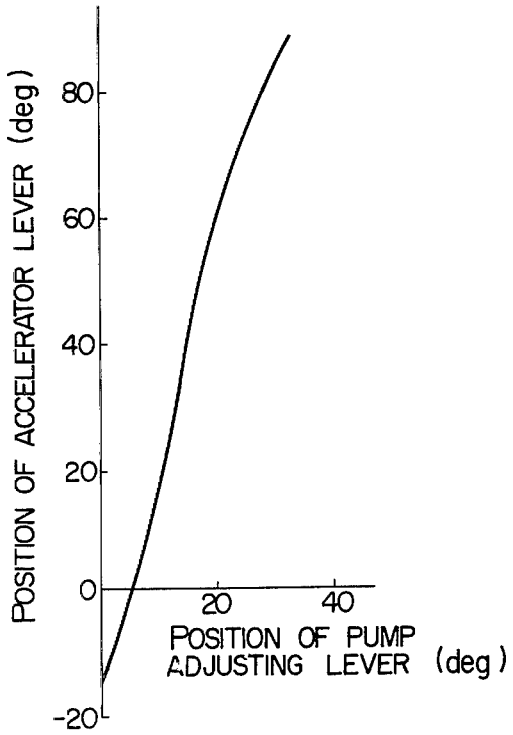
FIG. 10 is a characteristic chart showing the relationship between the position of a pump adjusting lever and the position of an accelerator lever.

FIG. 9 shows the relationship between the engine load and engine speed corresponding to FIG. 8*a* actually measured on a 4-cycle, 4-cylinder diesel engine provided with a distribution type fuel injection pumps and having vortex flow type combustion chambers of a total displacement of 2200 cc. More specifically, this Figure shows examples of the control of E.G.R. ratio as obtained by suitably setting various factors such as the mass of the fly-weight 8, spring constants of two control springs 17, 70 and so forth. In this engine, there is a relationship as shown in FIG. 10, between the position of the pump adjusting lever and the position of the accelerator pedal as shown in FIG. 7. The opening angle of the control spring 17 and the control spring 70, i.e. the angle $\theta_3'$ as shown in FIG. 7 is selected to be 58°.

As has been described, according to the invention, the exhaust-gas-recirculation is controlled in relation to both of the amount of depression of the accelerator pedal and the engine speed, so that the E.G.R. ratio is advantageously controlled always in response to the change in the level of the load.

In addition, the exhaust-gas-recirculation system of the invention can be designed irrespective of the type of the engine and/or fuel injection pump. More practically, the exhaust-gas-recirculation system of a substantially same design can be applied to various types of engines by a mere change of factors such as the mass of the fly-weight, spring constant of the control spring and so forth.

It is remarkable that the E.G.R. ratio is controlled also in response to the change in the engine speed, by a pure mechanical system constituted by a comparatively small number of parts.

What we claim is:

1. In an exhaust-gas-recirculation system for use in a diesel engine having an intake pipe connected to the engine to introduce fluid thereinto and an exhaust pipe connected to the engine to discharge exhaust gas therefrom, said system including an exhaust-gas-recirculation passage having one end thereof connected to said intake pipe and the other end connected to said exhaust pipe, and valve means associated with said exhaust-gas-recirculation passage to control the flow rate of the exhaust gas to be recirculated from said exhaust pipe to said intake pipe through said exhaust-gas-recirculation passage, the improvement which comprises:

a shaft rotatable in synchronization with the engine;

a fly-weight mounted on said shaft to produce a centrifugal force upon the rotation of said shaft;

a governor member movable in response to a thrust acting thereon due to the centrifugal force produced by said fly-weight;

at least one control spring acting against the thrust on said governor menber and having a spring load variable in response to the change in amount of depression of an accelerator pedal; and actuating means operative in response to the movement of said governor member to actuate said valve means.

2. An exhaust-gas-recirculation system claimed in claim 1, wherein said control spring is provided in plural so that the spring load is changed in a stepped manner in accordance with the change in amount of depression of said accelerator pedal.

3. An exhaust-gas-recirculation system claimed in claim 1 or 2, wherein said actuating means includes means for producing a pressure signal in relation to the movement of said governor member, and diaphragm means operative in response to the pressure signal to actuate said valve means.

4. An exhaust-gas-recirculation system claimed in claim 1 or 2, wherein said actuating means directly transmits the movement of said governor member to said valve means.

* * * * *